United States Patent [19]

van der Lely

[11] 4,068,430

[45] Jan. 17, 1978

[54] PREFABRICATED BOX-SHAPED STRUCTURAL SECTION

[76] Inventor: Cornelis van der Lely, 7, Bruschenrain, Zug, Switzerland

[21] Appl. No.: 531,376

[22] Filed: Dec. 10, 1974

Related U.S. Application Data

[63] Continuation of Ser. No. 402,083, Oct. 1, 1973, abandoned, which is a continuation of Ser. No. 138,479, April 29, 1971, abandoned.

[30] Foreign Application Priority Data

May 1, 1970 Netherlands ..... 7006497

[51] Int. Cl.[2] ..... E04B 5/29; E04C 2/04

[52] U.S. Cl. ..... 52/79.7; 52/264

[58] Field of Search ..... 52/79.7, 234, 79.1, 52/264

[56] References Cited

U.S. PATENT DOCUMENTS

| | | | |
|---|---|---|---|
| 3,225,434 | 12/1965 | van der Lely | 52/79 |
| 3,256,652 | 6/1966 | van der Lely | 52/234 |
| 3,289,382 | 12/1966 | van der Lely | 52/79 |
| 3,470,660 | 10/1969 | van der Lely | 52/79 |
| 3,484,999 | 12/1969 | van der Lely | 52/79 |
| 3,500,595 | 3/1970 | Bennett | 52/79 |

FOREIGN PATENT DOCUMENTS

| | | | |
|---|---|---|---|
| 608,401 | 2/1960 | Italy | 52/79.3 |

*Primary Examiner*—John E. Murtagh
*Attorney, Agent, or Firm*—Mason, Mason & Albright

[57] ABSTRACT

A prefabricated section for a building having a concrete slab floor with a concrete rim elevated relative thereto and spaced inboard a relatively short distance of the slab periphery. Walls are provided which are supported by metal beams which extend upwardly from the rim and have adjacent wooden beams. A ceiling member is provided which is supported by girders which are supported, in turn, by the metal beams. The girders also support the roof so that it is spaced a substantial distance above the ceiling. Insulation is provided immediately above the ceiling and against the inner wall sheets, the insulation being spaced from the roof and outer wall sheets. The upper ends of the metal beams have hoist connection members for receiving through closable openings in the roof hoisting cables and hooks for raising and moving the section. The walls, ceiling and roof are composed of materials which are light in weight compared to the concrete slab so that the center of gravity of the section is low. The concrete slab extends under the walls and the metal beams which support the walls are structurally connected to the slab either directly or through horizontal beams so that in hoisting the section via the beams, tension and compression stresses on the section are minimal.

9 Claims, 15 Drawing Figures

INVENTOR
CORNELIS VAN DER LELY
BY
Mason, Mason & Albright
Attorneys

INVENTOR
CORNELIS VAN DER LELY
BY
Mason, Mason & Albright
Attorneys

INVENTOR
CORNELIS VAN DER LELY
BY
Mason, Mason & Albright
Attorneys

INVENTOR
CORNELIS VAN DER LELY
BY
Mason, Mason & Albright
Attorneys

INVENTOR
CORNELIS VAN DER LELY
BY
Mason, Mason & Albright
Attorneys

INVENTOR
CORNELIS VAN DER LELY
BY
Mason, Mason & Albright
Attorneys

PREFABRICATED BOX-SHAPED STRUCTURAL SECTION

RELATED APPLICATIONS

This is a continuing application of application Ser. No. 402,083 filed Oct. 1, 1973, now abandoned, which is a continuing application of application Ser. No. 138,479 filed Apr. 29, 1971, now abandoned.

SUMMARY OF THE INVENTION

The invention relates to a prefabricated, box-shaped structural section comprising a floor provided with a concrete layer, at least two upright walls and a roof ceiling or a combination thereof such as to enclose a living space.

Known structural sections of the kind set forth are completely made of concrete.

According to the invention the walls are made of other material than concrete.

An advantageous wall construction is obtained by building the walls from spaced sheets. A strong construction can be obtained in a simple manner by providing the walls with a supporting structure of at least one or more metal frame beams connected with the floor of the section and provided at the top with the roof and/or ceiling structure. The connection of the walls with the floor can be established advantageously by providing the floor with one or more wooden beams, to which further supporting strips for the walls can be fastened. An advantageous construction of the joint between the wall and the floor can be obtained by causing the lower side of the wall to join a raised rim of the floor. A simple form is obtained by using a rim which is integral with the concrete layer of the floor. The rim and the concrete layer of the floor can thus be made in a single operation. A strong, light-weight structure of the top side of the section can be obtained by arranging therein transverse longitudinal girders or a combination thereof forming a framework.

The invention furthermore relates to a method of manufacturing a structural section, in which in accordance with the invention, first a floor of the section is made with the concrete layer, to which floor the walls are secured, the roof and/or the ceiling being secured to the walls or to the supporting beams of the walls.

For a better understanding of the invention and to show how the same may be carried into effect, reference is made by way of example to the accompanying drawing, which shows an advantageous embodiment.

DESCRIPTION OF THE PREFERRED EMBODIMENT

Figure 1:
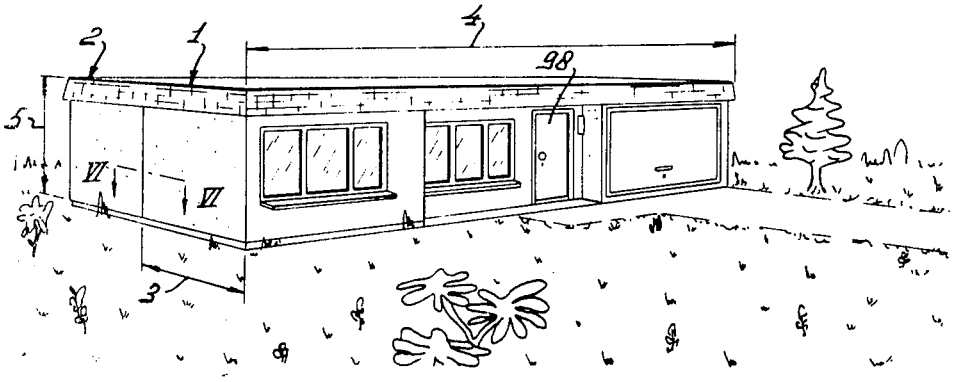
FIG. 1 is a perspective view of a building embodying the invention.

The house or building shown in the Figures comprises two prefabricated, box-shaped sections 1 and 2. The sections have the shape of a parallelopiped and have substantially the same dimensions. The width 3 is preferably larger than 2.25 ms and smaller than 4.5 ms. The length 4 of these sections is preferably larger than 10 ms and smaller than 15 ms. The height 5 of the sections is preferably from 2.50 ms to 3 ms. The sections are constructed mainly in the same manner, the shape and disposition of the inner and outer walls of each section being, however, adapted to the arrangement of the house.

Figure 2:
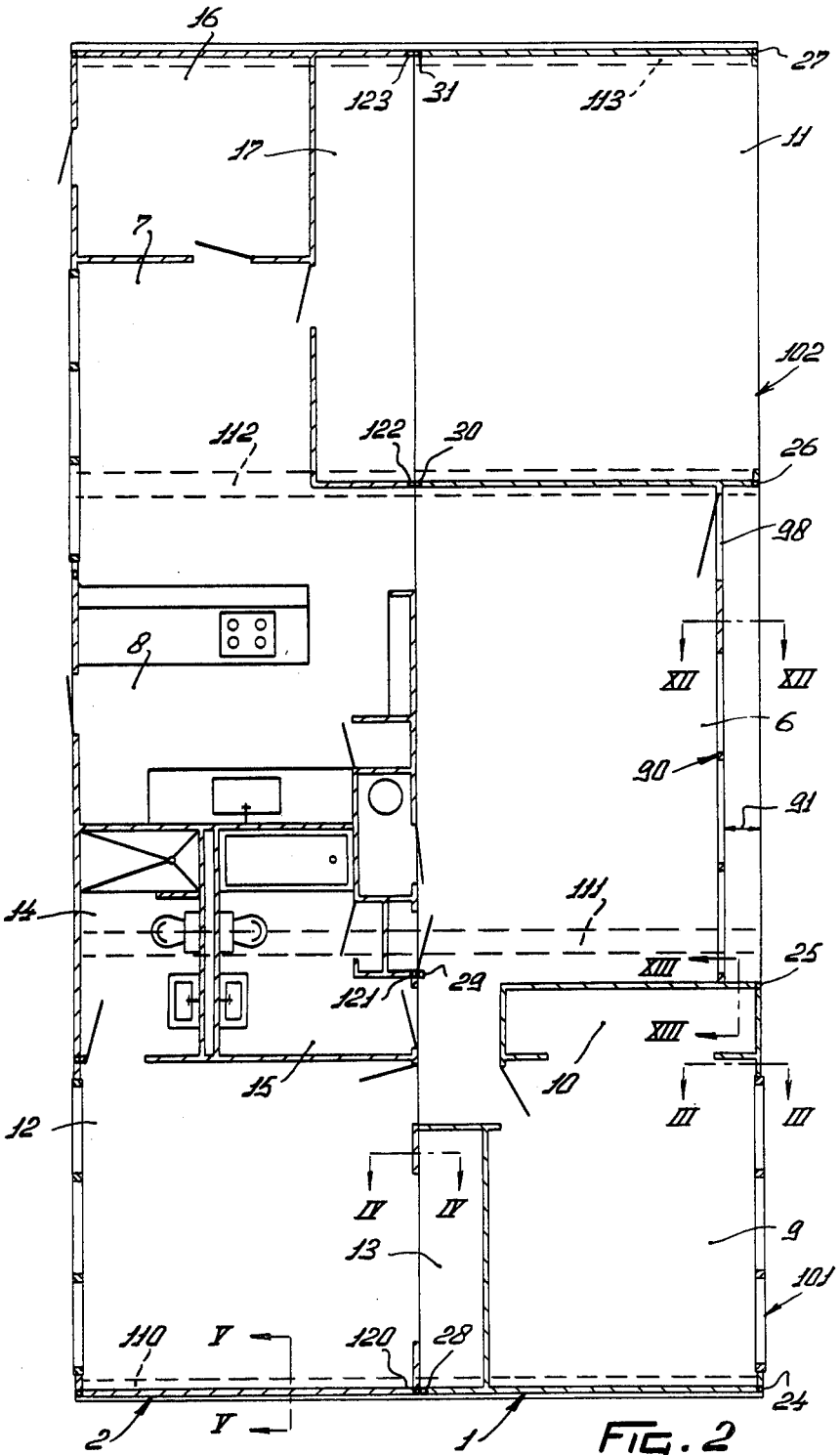
FIG. 2 is a plan of the building of FIG. 1 forming a house

From FIG. 2 it will be apparent that the house comprises a living room 6 and a dining room 7 with a kitchen 8. The section 1 comprises a bedroom 9 with a closet 10 and, in addition, the larger portion of a garage 11. The section 2 comprises a bedroom 12, the closet 13 associated with said bedroom being located in the section 1. The section 2 comprises furthermore two bathrooms 14 and 15 and a storage space 16 including a small portion 17 of the garage.

Each of the sections is prefabricated and comprises a concrete floor in a framework of metal beams. On said beams vertical frame beams are erected, to which the walls are secured, which may be formed by boards and/or plaster sheets joining either side of the beams. At the top of the vertical beams a roof with a ceiling is arranged. The construction of the sections will be specified below with reference to section 1.

Figure 3:
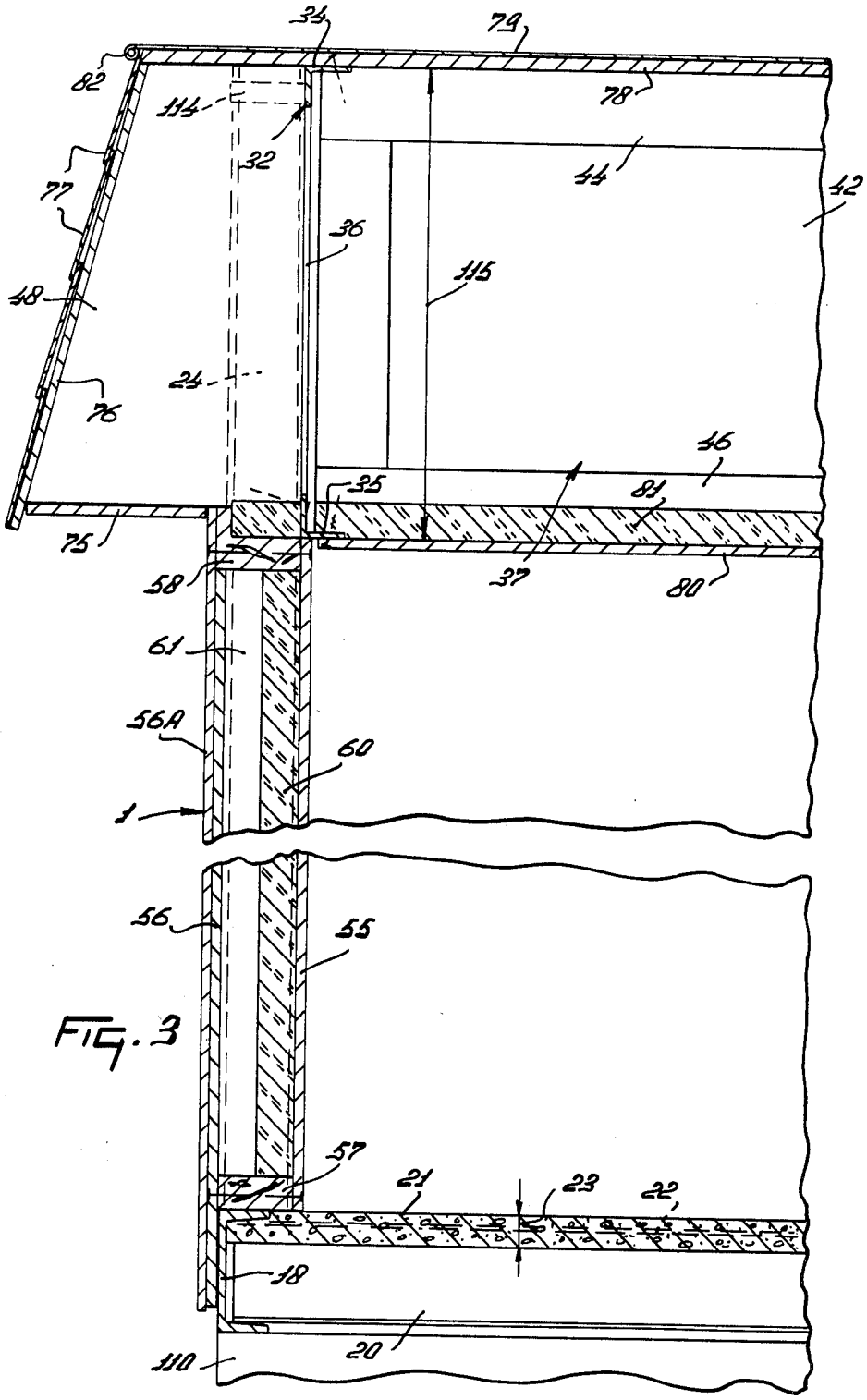
FIG. 3 is a vertical sectional view of part of the house taken on the line III—III of FIG. 2.
Figure 4:
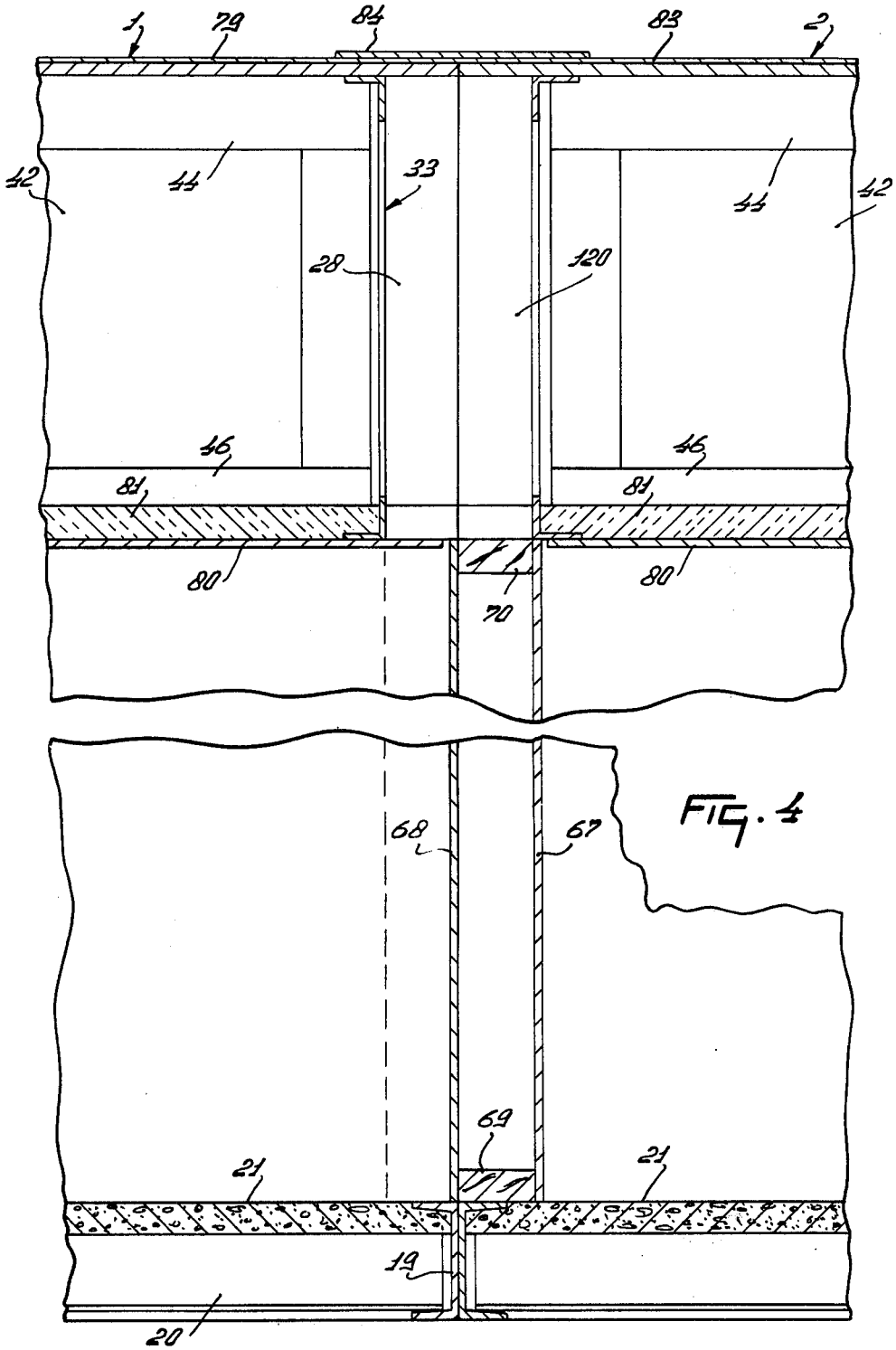
FIG. 4 is a vertical sectional view of part of the house taken on the line IV—IV in FIG. 2.
Figure 5:
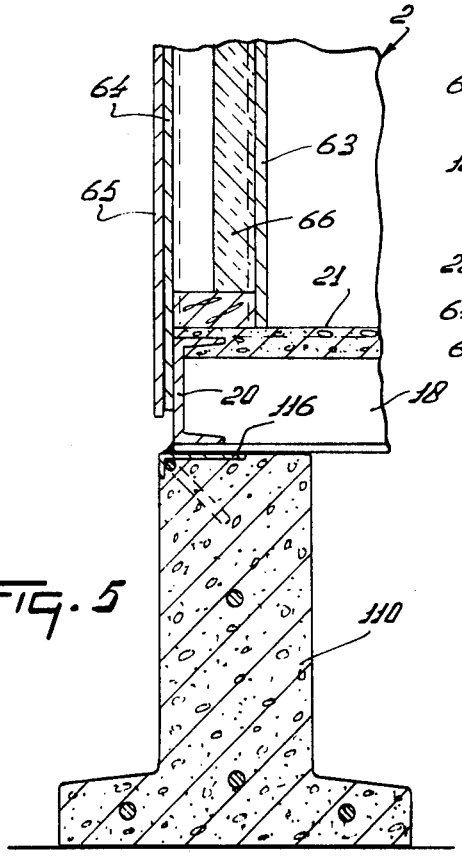
FIG. 5 is a vertical sectional view of the lower side of a section arranged on a foundation beam, taken on the line V—V in FIG. 2.
Figure 6:
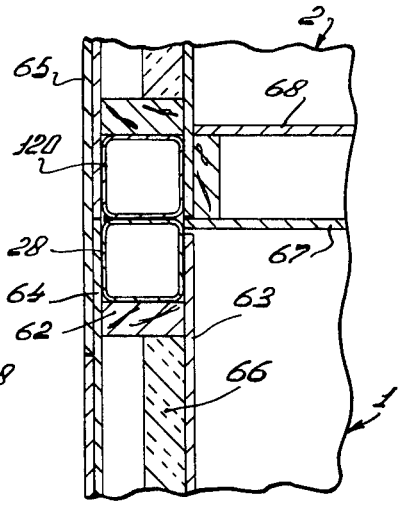
FIG. 6 is a horizontal sectional view of the outer sides of two adjacent sections forming the house, taken on the line VI—VI in FIG. 1.

The floor of the section 1 comprises a rectangular framework of channel-section metal beams i.e. two longitudinal beams 18 (FIG. 3) and 19 (FIG. 4), between which channel-section beams are secured (only one of them is shown in FIG. 3 and FIG. 5 which is designated by reference numeral 20). The frame beams at the shorter sides of the section floor, such as the beam 20, are arranged between the limbs of the longitudinal beams of the section. Inside the framework a concrete floor 21 is provided with reinforcement 22, secured to the beams of the framework. Between the beams 18 and 19 a plurality of metal ribs (not shown) extend parallel to the beam 20 and are embedded by their topside in the concrete floor 21, the ends of them being secured to the beams 18 and 19. In this way a strong floor of a concrete sheet 21 having a small thickness, for example, about 4 centimeters, can be obtained. On the top side of each of beams 18 and 19 are four vertical frame beams thus on beam 18, frame beams 24, 25, 26 and 27 are arranged on one long side of section 1. On the other long side of the section 1 four vertical frame beams 28, 29, 30 and 31 are arranged on the beam 19. These vertical beams are preferably hollow metal beams having in this embodiment a square section (see FIG. 6 for the beam 28). The vertical beams 24, 27, 28 and 31 are set up at the corners of the floor of the section, whereas the beams 25, 26, 29 and 30 are distributed along the longitudinal side of the section so that the inner walls are satisfactorily supported thereby. The disposition of the latter beams is furthermore such that they form a satisfactory support for the roof secured to the top sides of the vertical beams and for any outer walls secured thereto.

Figure 8:
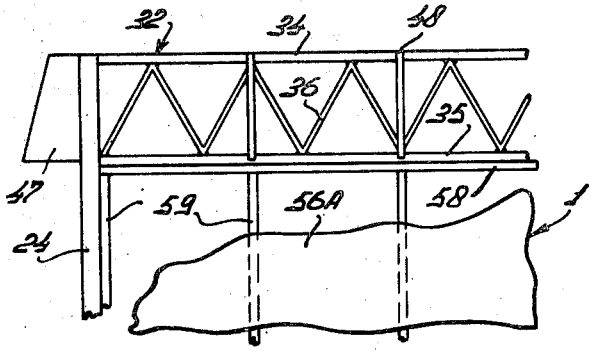
FIG. 8 is a side elevation of a longitudinal girder on the upper side of the section taken in the direction of the arrow VIII in FIG. 7.
Figure 9:
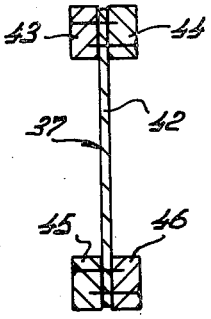
FIG. 9 is a vertical sectional view of a transverse girder taken on the line IX—IX in FIG. 7.
Figure 7:
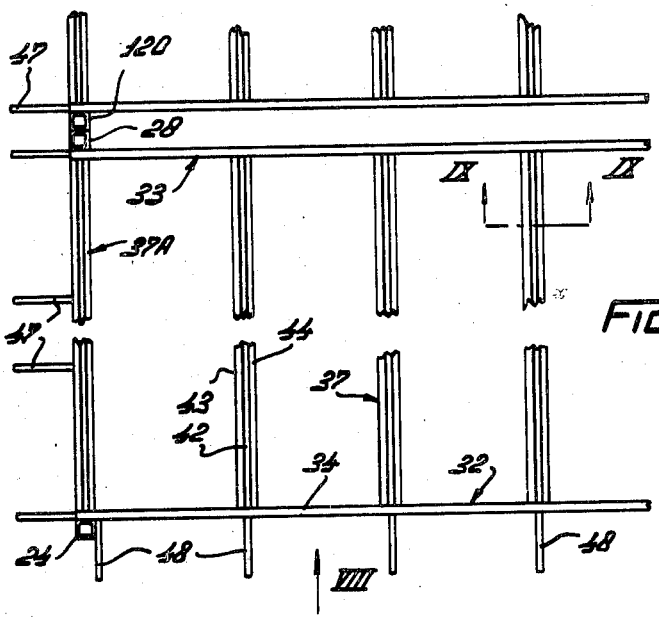
FIG. 7 is a plan view of the roof of a section of the house.
Figure 10:
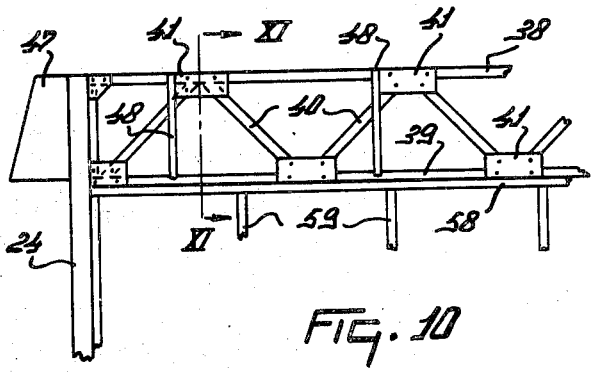
FIG. 10 is a side elevation of a further embodiment of the transverse girder.
Figure 11:
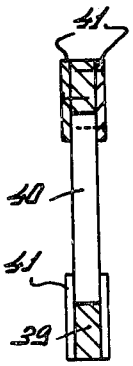
FIG. 11 is a vertical sectional view taken on the line XI—XI in FIG. 10 of the transverse girder of FIG. 10.

The beams 24, 25, 26 and 27 are interconnected at the top ends by a longitudinal girder 32, whereas the beams 28 to 31 are interconnected by a longitudinal girder 33. These girder 32 and 33 are each formed by a framework formed, as is shown in FIG. 8 for the girder 32, by two parallel beams 34 and 35 and struts 36. The longitudinal girders 32 and 33 are preferably made of metal, on the beams 34 and 35, like the struts 36, are formed by angle-section irons. The longitudinal girders 32 and 33 are interconnected by a plurality of longitudinal girders 37, extending parallel to the shorter sides of the section. These longitudinal girders 37, as shown in FIG. 9, may be formed by a plate 42 of board or plywood. At the top, on either side of the plate, wooden beams 43 and 44 are arranged and fastened to the plate by glue nails, or both. At the bottom of the plate 42 beams 45 and 46 are arranged on either side and connected thereto by glue or nails. The transverse girders, as is shown in FIGS. 10 and 11, may be formed by a framework comprising two parallel beams 38 and 39. These beams 38 and 39 may be made of wood and be interconnected by wooden struts 40. The struts 40 and the beams 38 and 39 are interconnected by wooden cover plates 41. Although in this embodiment the transverse girder 37A at the end of a section is identical to the other transverse girder, it may be constructed in the same manner as the longitudinal girders 32 and 33.

The transverse girder 37A at the end of a section is provided with consoles 47, to which a roof edge is secured. The transverse girder 32, located on the outer side of the building, is provided with consoles 48, to which also a roof edge is secured.

The walls are mainly formed by wall sheets arranged on either side of the vertical frame beams 24 to 31, between which a cavity is formed. These wall sheets are secured to supporting ribs connected with the vertical and horizontal beams of the section frame. The supporting part of a section is mainly formed by a frame formed by the framework of the floor and the vertical frame beams arranged thereon and the longitudinal girders and transverse girders at the top of the vertical frame beams. The front wall of the house of the section 1 comprises a board sheet 55 (FIG. 3), which is located on the inner side of the wall and board sheet 56, located on the outer side. These board sheets 55 and 56 are fastened at the bottom to a wooden beam 57, which is fastened to the frame beam 18 and anchored by means of anchorage irons (not shown) in the concrete of the floor plate 21. At the top the board plates 55 and 56 are connected with a wooden beam 58, which is secured to the longitudinal girder 32. Between the beams 57 and 58, as is shown in FIG. 8, vertical supporting ribs 59 are arranged, to which the board sheets 55 and 56 are also secured. The board sheet 56 extend along the vertical beams 24 to 27 so that these beams are located between the sheets and are completely covered. On the outer side of the board plate 56 a watertight outer layer 56A is provided, which is resistant to weather conditions. This outer layer may be formed by an aluminium foil. Between the sheets 55 and 56 an insulating layer 60 is located at a distance from the outer sheet 56 and is in contact with the sheet 55. This insulating layer 60 is located between the vertical supporting ribs 59. Between the insulating layer 60 and the sheet 56 a cavity 61 is formed. At the bottom side the sheet 56 and the cover plate 56A extend along the larger portion of the beam 18, only the lower portion of said beam 18 being exposed so that during transport and displacement of the sections on the foundation the lower sides of the sheet 56 and of the outer layer 56A will not be damaged. At the places of doors and/or windows in the outer and inner walls and the facade said parts are secured to the beams of the section. Along the vertical metal frame beams of the sections wooden supporting ribs of the kind shown in FIG. 6 for the vertical frame beam 28 are provided. Along the inner side of the vertical frame beam 28 a supporting rib 62 is secured, to which the board sheets 63 and 64 are fastened, which form a side facade. On the outer side the sheet 64 is provided with an outer layer 65 and on the inner side of the sheet 63 an insulating layer 66 is secured. The inner walls, as is shown in FIG. 4, are formed by two board sheets 67 and 68 on either side of vertical supporting ribs such as 59. The board sheets 67 and 68 may be provided on the side facing the room with ornamental layers such as wallpaper or paint. The sheets 67 and 68 of the inner walls are secured at the bottom and at the top to wooden ribs 69 and 70 of the section, fastened to the frame beams of the floor and the roof.

At the top of the walls, as is shown in FIG. 3, a roof edge projects from the facade. The roof edge comprises a portion 75, which is secured to the bottom side of the consoles 48 near the front side of the front or to the bottom side of the consoles 47 near a sidewall. Along the outer side of the consoles 48 a covering plate 76 is provided, which is covered on the outer side by covering strips 77. At the top of the section, on top of the girders 32, 33 and 37 a roof of roofing sheet 78 with a covering layer 79 is provided. The roof plate 78 can be simply secured to the wooden transverse girders 37 by nails. On the bottom side of the transverse girders 37 a ceiling 80 is secured in a simple manner. FIG. 3 shows a portion of a ceiling 80, which is formed by ceiling sheets and an insulating layer 81 on the top side thereof. The ceiling 80 can be simply secured to the bottom side of the transverse wooden girders, for example, by means of nails. The insulating layer 81 can be easily arranged between the wooden girders and secured thereto. If desired, the ceiling 80 and the roof 78 may be secured to the metal longitudinal girders. Near the outer walls, as is shown in FIG. 3, the roof 78 projects to the outer side of the vertical frame beams and is secured to the top side of the consoles 48. The roofing 79 joins by a bent-over rim 82 the covering 77. At the junction of the sections 1 and 2 a covering strip 84 can be applied to the roofing 79 of the section 1 and the roofing 83 of the section 2, after the sections have been secured to each other.

Figure 12:
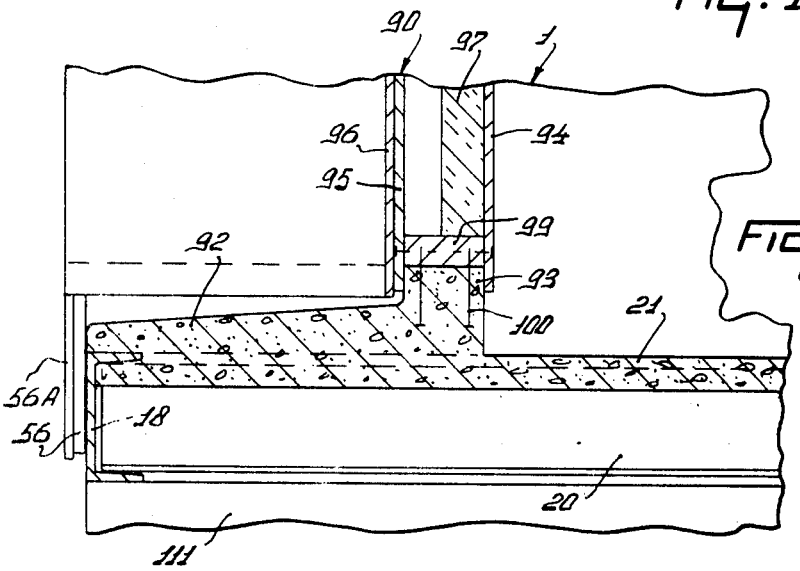
FIG. 12 is a vertical sectional view of part of a wall joining the bottom of a section taken on the line XII—XII in FIG. 2.
Figure 13:
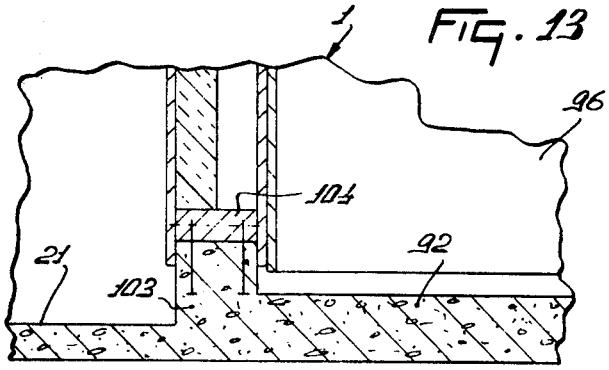
FIG. 13 is a vertical sectional view of the junction of a wall with the bottom of a section taken on the line XIII—XIII in FIG. 2.

At the area where a vertical wall of the section does not join the outer circumference of the floor of the section an upright ridge may be provided on the floor of the section, as is shown in FIGS. 12 and 13 for joining the wall. The wall portion 90 is located, as is shown in FIG. 2, over a distance 91 inside the circumference of the floor slab. Over this distance 91 the floor slab is provided with an elevation 92, which is provided with an upright rim 93 at the place of the rim 91, the wall 90 being arranged on the rim 93. The wall 90 may be formed, as indicated in the foregoing for the outer wall, on the lower part by two board sheets 94 and 95, an outer layer 96 being applied to the outer side of the sheet 95, whereas between the sheets 94 and 95, on the inner side of the sheet 94 an insulating layer 97 is provided. The board sheet 94 may be provided on the inner side with a decorative paint or a paper layer. Above the lower portion of the wall 90 windows (FIG. 1) are provided and in part of the wall a door, for example, the door 98, is provided. For fastening the wall to the upright wall 93 a wooden beam 99 is provided, which is anchored by means of anchorages 100 in the concrete layer of the upright rim 93. The upright rim 93 with the elevated portion 92 together with the concrete floor slab 21 are cast in one operation. The wall strips (FIG. 13) between the re-entrant wall 90 and the wall portions 101 and 102 are formed like indicated in the foregoing for the other outer walls, so that further description is dispensed with. For these wall strips a rim 103 joins the upright rim 93 and is provided with a wooden girder 104, to which the boards of these wall strips are secured.

The sections 1 and 2 are completely prefabricated with the floor, the walls, the roof and the inner walls. The inner and outer walls are provided with suitable covering layers and during the prefabrication the required ducts, for example, for gas, electricity and water are arranged inside the sections. The outer layer 65 may be advantageously formed by aluminium sheet, wood or stone or cement materials. It is also possible to apply to the outer side of the layer 64 a brick wall afterwards. When the sections are completely ready, they are transported to the site and disposed on the prearranged foundation beams, such as the four foundation beams 110, 111, 112 and 113. These foundation beams may be prefabricated beams or they may be cast in situ. In order to permit displacement and transport of the sections from the workshop of prefabrication, the sections may be provided with fastening points for hoistening. FIG. 3 shows a hoistening eyelet or pin 114. These hoistening eyelets may be secured at the desired spots on the vertical frame beams or the longitudinal girders 32 and 33. At the spots of the hoistening eyelets 114 openings may be left in the roof portions secured to the sections, said openings being closed at the site when the sections need no longer be lifted by the eyelets or pins. The eyelets 114 can advantageously be secured to the vertical frame beams 24 and 27 and 25, 26 respectively, since these vertical beams extend up to the top of the sections and project above the ceiling 80 over a distance 115. The longitudinal girders 32 and 33 are arranged on the inner side of the vertical frame beams so that on the outer side of these longitudinal girders sufficient space is left for fastening the hoistening eyelets to which the hoistening tools are fastened for displacement and transport of the sections.

When the sections are arranged in place on the foundation beams 110 to 113, they may be secured to the foundation beams by welding or bolting. The foundation beams may be provided with metal strips 116 so that the metal beams of the lower sides of the sections can be readily arranged thereon. The sections can be coupled with each other by fastening the adjacent vertical frame beams, for example, the beams 28 to 31 and the beams 120 to 123 of the section 2. Fastening may be performed by bolts or small welds. The top ends of these vertical beams may be interconnected by welds. In the seams of the roof portions shown in FIG. 4, small recesses may be provided at the area of the joining beams, said recesses being closed after the sections are fastened to each other. The covering strip 84 can then be applied to the whole seam. The sections may be interconnected by welding or bolting, the creeping space beneath the sections and between the foundation beams 110 to 113 being used for connecting the lower sides of the sections with each other and/or with the foundation beams.

Figure 14:
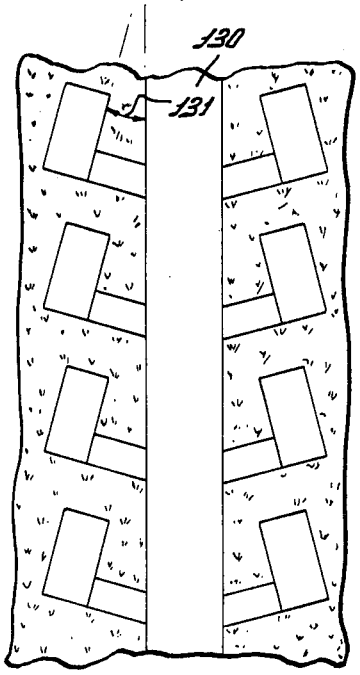
FIG. 14 shows the arrangement of two rows of houses embodying the invention on either side of a road.

The houses formed by sections in accordance with the invention may be arranged advantageously along a road 130 as shown in FIG. 14. The detached houses have their longer sides at an acute angle 131 of preferably about 15° to the center line of the road 130. Owing to this disposition of the buildings inclined to the direction of length of the road the houses may be arranged in staggered positions or advantageously in off-set positions. In the embodiment shown in FIG. 14, as will be apparent from the positions of the garage drives, the houses on either side of the road are symmetrical to the center line of the road. Although this is not shown in the embodiment, the sections may be equipped with ducts and central heating and/or air-conditioning systems during the prefabrication. These ducts may advantageously be arranged between the ceiling 80 and the roof 78.

Since the floor of a section is formed by a thin concrete slab, drying thereof takes little time, which is advantageous for a rapid prefabrication. The concrete floor provides a sturdy, compact structure satisfactorily resistant to vermin. By forming the walls from spaced sheets, light-weight walls are obtained, which have excellent properties for a building, for example a satisfactory insulation. The fabrication method is thus improved because the use of dry materials for the walls has a favorable effect on the rate of manufacture. Instead of using board and/or plaster sheets for the walls sheets of other materials may also be employed. Since the metal vertical frame beams are covered by the sheets (see FIG. 6 for the beams 28 and 120), these metal beams are somewhat insulated, so that they will not form bridges between spaces of different temperature. The longitudinal girders 32 and 33 and the transverse girders 37 of the frameworks provide a rigid, but light-weight structure. Owing to the concrete floor and sheet walls a light-weight section is obtained, the center of gravity of which is at a low level, which is important for transport purposes. It is thus also possible to make large size sections so that a building can be composed of few sections. The sections embodying the invention can be manufactured at low costs.

Figure 15:
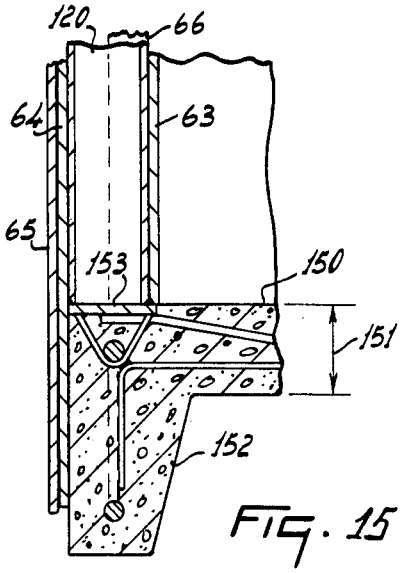
FIG. 15 is a vertical sectional view of the junction of a wall with the bottom of a section, said bottom having a structure differing from that of the preceding Figures.

Although in the embodiment described above the sections comprise a floor formed by a concrete slab inside a framework of metal beams and metal ribs, the floor may be completely made of concrete, as shown in FIG. 15. In this embodiment the floor is formed by a concrete slab 150 having a thickness 151 of, for example, about 10 centimeters. Along the periphery of said slab stiffening ribs 152 are provided, which are integral with the floor slab. The floor slab and the ribs are reinforced. Between the ribs at the periphery of the floor further ribs may be provided for supporting the floor, which are also integral with the floor slab. The floor has secured to it the fastening plates 153, for example, of metal at the junctions of the metal frame beams, for example, the beams 24 to 31 with the floor. These beams may be welded to the fastening plates for establishing a satisfactory connection of the walls with the floor.

As used in the preambles of the claims, a prefabricated section is a modular unit of a size which can be independently moved as a unit without interrupting traffic on modern highways — generally about 2.5 - 4.5 meters in width and 7 - 16 meters in length — and which, when connected with one or more other similar modular units, comprises a building such as a dwelling, school, office or the like.

Having thus described my invention I claim as new and desire to secure by letters patent of the United States is:

1. A prefabricated box-shaped structural section which comprises a concrete slab floor with a vertically disposed periphery, at last two upright walls, and a ceiling member, said floor comprising a concrete slab and horizontally disposed structural metal beams surrounding and connected with at least the greater part of said periphery of said concrete slab, said floor slab being provided with a rim which is elevated relative to the remainder of the slab and is spaced a relatively short distance inboard of said periphery and is substantially parallel therewith, said walls joining said rim at least in part, said upright walls having at least two upright beams secured to said metal beams of said floor with their outer facing sides flush with said vertically disposed periphery, wall sheets mounted on opposite inner and said outer facing sides of said upright beams so that the beams are situated between the wall sheets, said wall sheets mounted on said outer facing sides of said upright beams overlapping and contacting said vertically disposed periphery, said walls being composed of a non-concretitious material providing a density substantially less than concrete and including between sheets a non-concretitious insulating material, the upper ends of each of said upright beams being connected with longitudinal and transverse beams provided to form with said upright beams and said horizontal metal beams a parallelepiped frame structure, a ceiling member being connected to said longitudinal and transverse beams, said ceiling member being composed of light weight non-concretitious materials whereby the section has a relatively low center of gravity.

2. A prefabricated box-shaped structural section which comprises a floor, at least two walls, and a ceiling member, said floor comprising a concrete slab, horizontally disposed structural metal beams surrounding at least a greater part of the periphery of said concrete slab, said concrete slab having a rim which is elevated relatively to substantially the entire remainder of said concrete slab, at least part of said walls joining said elevated rim, said walls being composed of a non-concretitious material providing a density substantially less than concrete, said walls having sheets on opposite inner and outer facing sides of upright beams provided in said walls so that the beams are situated between said wall sheets, the lower ends of said upright beams being connected to said horizontal metal structural beams of said floor, the upper ends of each of said upright beams being connected with longitudinal and transverse beams to form with said upright beams and said horizontal metal beams, a parallelepiped frame structure, a ceiling member being connected to said longitudinal and transverse beams, said ceiling member being composed of light weight non-concretitious materials whereby the section has a relatively low center of gravity.

3. A prefabricated box-shaped structural section in accordance with claim 2 wherein at least part of said walls joining said elevated rim are provided with inner and outer sheets which overlap vertical sides defining said elevated rim.

4. A prefabricated box-shaped structural section in accordance with claim 2, wherein said elevated rim is in part spaced inboard from the periphery of said concrete slab and at least one part of said rim joins said inboard rim part and said periphery.

5. A prefabricated box-shaped structural section in accordance with claim 4, wherein the outboard portion of said concrete slab between said rim parts and said periphery is higher than the remaining part of said concrete slab other than said rim.

6. A prefabricated box-shaped structural section which comprises a floor having a concrete layer and horizontally disposed structural metal beams including horizontal portions which are in part in said layer and which portions extend around at least a greater part of the periphery of said concrete layer, said layer being provided with a rim elevated relative to adjoining parts of said layer, at least two upright walls joining said rim, and a horizontal ceiling member, each said wall having at least two upright hollow beams rigidly secured to said horizontal portions of the corresponding of said horizontal structural metal beams, wall sheets mounted on opposite inner and outer facing sides of said upright beams, said upright beams being interconnected on the upper sides by girders, a horizontal roof structure, said ceiling member and said roof structure being substantially parallel throughout and connected to said girders whereby they are spaced apart throughout substantially their proximate horizontal areas, said wall sheets being composed of non-concretitious materials and being provided at opposite sides of said upright beams so that said upright beams are situated between said wall sheets.

7. A prefabricated box-shaped structural section in accordance with claim 6, wherein hoist connection members for displacing said section vertically are connected to said girders.

8. A prefabricated box-shaped structural section which comprises a floor having a concrete slab and horizontally disposed structural metal beams including a horizontal portion thereof disposed around at least the greater part of the periphery of said concrete slab, said horizontal portion extending in said slab at least in part, at least two upright walls, upright beams, a ceiling member, and a roof structure, said slab including a rim which is elevated relative to the adjoining parts of said slab, said walls joining said elevated rim, each said wall including at least two of said upright beams which are rigidly secured to said horizontal portion of the corresponding of said horizontal structural metal beams, said upright beams being situated on the corners of said concrete slab, interior and exterior wall sheets mounted on opposite sides of said upright beams which are situated on the corners of said concrete slab, said exterior wall sheets extending over said upright beams and said horizontal portion, said upright beams being interconnected in their upper sides by girders, said ceiling member and said roof structure being connected to said girders, said upright beams extending above said ceiling member to proximate said roof structure and being provided above said ceiling member with a plurality of hoist connection members adapted for a connection to hoisting means for transport and vertical displacement of the section.

9. A prefabricated box-shaped structural section in accordance with claim 8, wherein said hoist connection members are connected to said girders.

* * * * *